US007501056B2

(12) United States Patent
Henkin et al.

(10) Patent No.: US 7,501,056 B2
(45) Date of Patent: Mar. 10, 2009

(54) POSITIVE PRESSURE POOL CLEANER PROPULSION SUBSYSTEM

(75) Inventors: Melvyn L. Henkin, Ventura, CA (US); Jordan M. Laby, Ventura, CA (US)

(73) Assignee: Henkin-Laby, LLC, Ventura, CA (US)

( * ) Notice: Subject to any disclaimer, the term of this patent is extended or adjusted under 35 U.S.C. 154(b) by 547 days.

(21) Appl. No.: 11/283,043

(22) Filed: Nov. 18, 2005

(65) Prior Publication Data

US 2006/0065580 A1 Mar. 30, 2006

Related U.S. Application Data

(63) Continuation of application No. PCT/US2004/016937, filed on May 27, 2004.

(60) Provisional application No. 60/475,093, filed on Jun. 2, 2003.

(51) Int. Cl.
*A47L 7/00* (2006.01)
*E04H 4/16* (2006.01)

(52) U.S. Cl. ..... 210/167.17; 15/1.7; 4/490; 137/624.14

(58) Field of Classification Search ..... 15/7; 4/490; 137/624.14, 625, 48, 869; 210/167.15, 210/167.16, 167.17; 251/63
See application file for complete search history.

(56) References Cited

U.S. PATENT DOCUMENTS

| | | | |
|---|---|---|---|
| 3,392,738 | A | 7/1968 | Pansini |
| 3,805,815 | A | 4/1974 | Goodin |
| 3,860,518 | A | 1/1975 | Henricksen |
| 3,921,654 | A | 11/1975 | Pansini |
| 4,129,904 | A | 12/1978 | Pansini |
| 4,154,680 | A | 5/1979 | Sommer |
| 4,569,361 | A | 2/1986 | Frentzel |
| 4,652,366 | A | 3/1987 | Brooks |
| 4,686,728 | A | 8/1987 | Rawlins |
| 4,749,478 | A | 6/1988 | Brooks |
| 4,837,886 | A | 6/1989 | Rawlins |
| 4,994,178 | A | 2/1991 | Brooks |
| 5,133,854 | A | 7/1992 | Horvath |
| 6,090,219 | A | 7/2000 | Henkin et al. |
| 6,365,039 | B1 | 4/2002 | Henkin et al. |

FOREIGN PATENT DOCUMENTS

| | | | |
|---|---|---|---|
| CA | 590252 | A | 1/1960 |
| JP | 54-056254 | A | 5/1979 |

*Primary Examiner*—Terry K Cecil
(74) *Attorney, Agent, or Firm*—Freilich, Hornbaker & Rosen

(57) ABSTRACT

An automatic pool cleaner configured to be powered by a supplied positive pressure water flow including an improved propulsion subsystem for propelling the cleaner body through a swimming pool along a substantially random travel path. The subsystem includes a hydraulic valve actuator configured to use water pressure to switch a valve element mounted for reciprocal linear movement from a default state (e.g., redirect travel state) to an active state (e.g., forward travel state) and to then restore the valve element to the default state. The water pressure for controlling the actuator is selectively supplied by a direction controller which responds to regular periodic occurrences and/or irregularly occurring events such as the interruption of cleaner body motion.

7 Claims, 8 Drawing Sheets

UP + CLOCKWISE
104

BACK + CLOCKWISE
120

HOSE
122
UP + CLOCKWISE

104
UP + BACK

HOSE
122
UP

POSITIVE PRESSURE POOL CLEANER PROPULSION SUBSYSTEM

RELATED APPLICATIONS

This application is a continuation of PCT/US2004/016937 which claims priority based on U.S. Provisional Application 60/475,093 filed on 2 Jun. 2003. This application claims priority based on the two afforested applications.

FIELD OF THE INVENTION

This invention is directed to automatic swimming pool cleaners configured to be propelled by a positive pressure water source.

BACKGROUND OF THE INVENTION

Automatic cleaners adapted to travel through a swimming pool for cleaning debris from the water and/or wall surface are well known in the art. Some such cleaners are configured to be powered by a water flow supplied from a positive pressure source, e.g., an electric pump. The supplied water flow typically drives a propulsion subsystem configured to propel the cleaner body along a travel path through the pool with the subsystem functioning primarily to move the cleaner body in a first direction (i.e., forward state) in the pool and to occasionally redirect the cleaner body (i.e., backup/redirect state) in a different, or second, direction. By so redirecting the cleaner body, the risk that it will get trapped behind an obstruction in the pool is minimized.

U.S. Pat. No. 6,365,039 (incorporated herein by reference) describes various positive pressure cleaner embodiments which incorporate a propulsion subsystem for moving the cleaner body along its travel path. The propulsion subsystems described therein generally include a valve assembly carried by the cleaner body which, in a forward state, directs a supplied water flow along a first interior path to produce forces on the body for moving it in a first direction or, in a backup/redirect state, along a second interior path to produce forces on the body to redirect it in a second direction different from the first direction. The valve assembly embodiments described in U.S. Pat. No. 6,365,039 employ a valve actuator for controlling a valve element mounted for reciprocal linear movement between first and second positions for respectively directing the supplied water flow along either the first or second interior path. When the actuator is activated, it moves the valve element from a default position to an actuated position to open one of said interior paths. When the actuator is deactivated, a spring in the actuator restores the valve element to its default position to open the other of said interior paths.

SUMMARY

The present invention is directed to an automatic pool cleaner configured to be powered by a supplied positive pressure water flow and more particularly to an improved propulsion subsystem for propelling the cleaner body through a swimming pool along a substantially random travel path.

A propulsion subsystem in accordance with the present invention includes a valve assembly selectively operable in (1) a forward travel state or (2) a backup/redirect (or "redirect") travel state. The valve assembly is operable in (1) said forward state to discharge a water flow or "jet", through discharge outlet(s) in a direction to produce a forward thrust on the cleaner body and (2) operable in said backup/redirect state to discharge a water jet through discharge outlet(s) in a direction to produce a thrust to redirect the cleaner body. The valve assembly includes one or more valve elements mounted for reciprocal linear movement and at least one valve actuator for selectively moving the valve element to define one of said states.

A preferred valve actuator in accordance with the invention is configured to use water pressure to switch the valve element from a default state (e.g., redirect travel state) to an active state (e.g., forward travel state) and to then restore the valve element to the default state. The use of water pressure to restore the valve element to the default state, rather than springs, enhances actuator efficiency and reliability. The water pressure for controlling the actuator is selectively supplied by a direction controller which responds to regular periodic occurrences anchor irregularly occurring events such as the interruption of cleaner body motion.

A valve actuator in accordance with a preferred embodiment of the invention employs a piston mounted for reciprocal linear motion. The piston has oppositely directed first and second faces which preferably have different effective areas. Thus, when positive pressure from a water source is applied to both faces, a greater force will be produced on the larger face to force the piston in a first direction to define one state. When pressure is removed from the larger face, the pressure on the smaller face will act to force the piston in a second direction to define the default state. It should be understood that the term piston as used herein is intended to broadly include a wide variety of members configured to exhibit reciprocal linear motion, e.g., a disk, a diaphragm, etc.

In a preferred two state valve in accordance with the invention, a single valve actuator linearly moves a valve element to either a first position to define an active, e.g., forward propulsion, state or a second position to define a default, e.g., redirect, propulsion state.

Whereas a valve assembly capable of defining two states is sufficient for establishing forward or redirect motion, a greater number of valve states is required for a cleaner additionally intended to selectively operate both at the water surface and at the containment wall surface (where "wall surface" should be understood as referring to both bottom and side wall portions). Such operation requires that the valve assembly be able to selectively define at least the following state/mode conditions:

1. Backup/Redirect
2. Forward/Water Surface
3. Forward/Wall Surface

A preferred three state valve assembly in accordance with the invention arranges three outlet ports in alignment such that two reciprocally moveable valve elements, can cooperatively define anyone of the three state/mode conditions. More particularly, in a preferred embodiment, three outlet ports (i.e., Backup/Redirect, Forward/Water Surface and Forward/Wall Surface) are physically aligned with the Backup/Redirect port being located between the Forward/Water Surface and Forward/Wall Surface ports. Each of these outlet ports is respectively coupled to a discharge outlet for discharging a water jet in a direction to produce the desired thrust. The first valve element is moveable between a first position where it opens the Forward/Water Surface port and closes the Backup/Redirect port and a second position where it closes the Forward/Water Surface port and opens the Backup/Redirect port. The second valve element is moveable between a first position where it opens the Forward/Wall Surface port and closes the Backup/Redirect port and a second position where it closes the Forward/Wall Surface port and opens the Backup/Redirect port. This configuration enables the valve assembly to be switched from either of the forward mode conditions to the redirect state by activating only a single actuator.

In accordance with a further significant aspect of a preferred embodiment of the invention, the Backup/Redirect outlet port is coupled to a discharge outlet on the body oriented to discharge water jets in a direction to produce a moment acting to rotate the cleaner body to redirect its travel path. More particularly, the Backup/Redirect discharge outlet is preferably comprised of nozzles respectively mounted at the front and rear of the cleaner body. The front and rear nozzles are preferably oriented to discharge water jets having oppositely directed horizontal components for rotating the body. At least one of the nozzles is also preferably oriented to discharge a jet having a vertical component for lifting the body.

DETAILED DESCRIPTION

Figure 1:
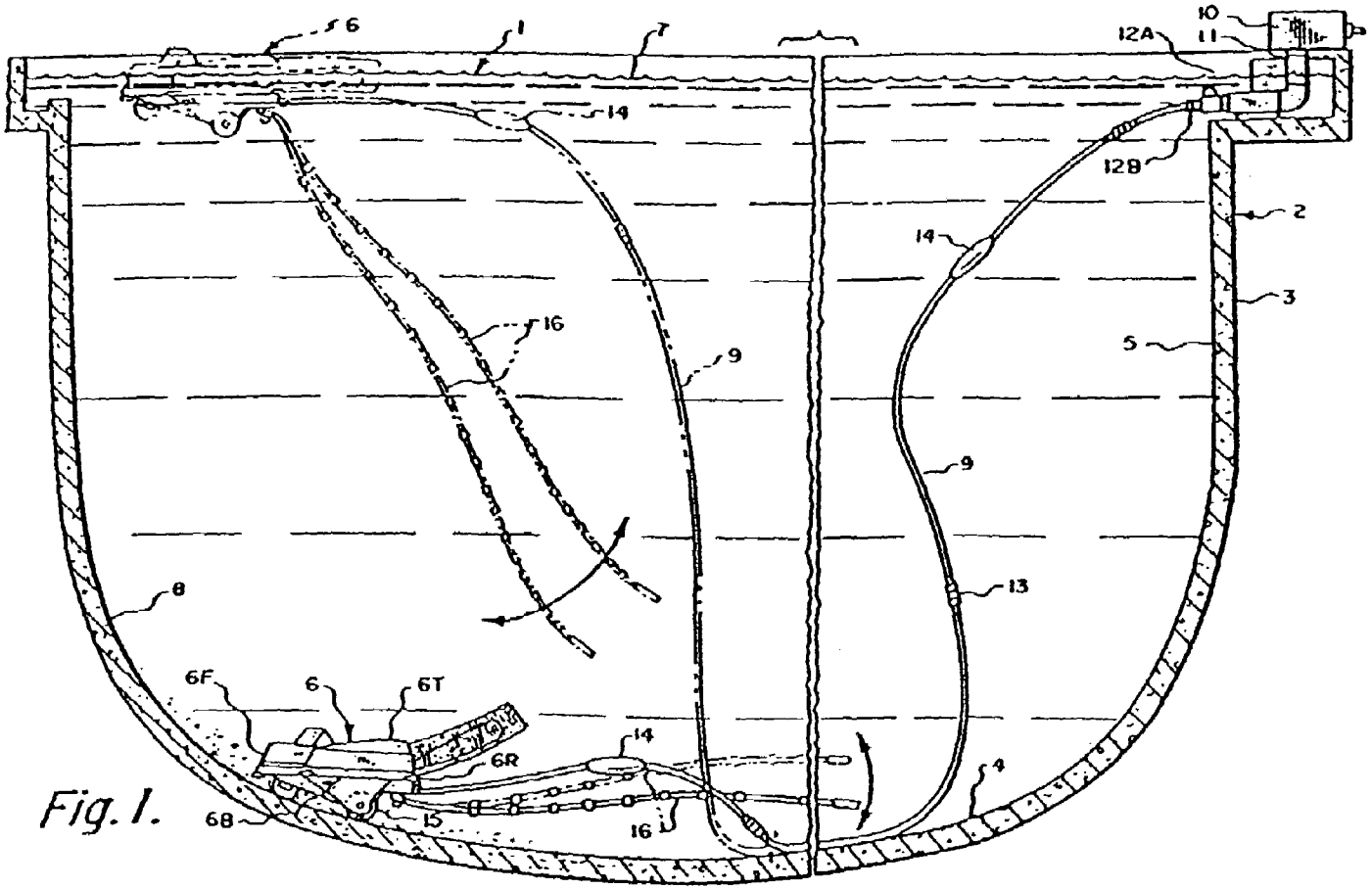
Fig. 1. PRIOR ART
FIG. 1 corresponds to FIG. 1 of U.S. Pat. No. 6,365,039 and depicts a pool cleaner body adapted to be propelled along a travel path proximate to the wall surface and/or the water surface.

Attention is initially directed to FIG. 1 which corresponds to FIG. 1 of U.S. Pat. No. 6,365,039 whose disclosure is by reference incorporated herein. FIG. 1 illustrates an automatic pool cleaner apparatus for cleaning a water pool 1 contained in an open vessel 2 defined by a containment wall 3 having bottom 4 and side 5 portions. Embodiments of the invention utilize a unitary structure or body 6 configured for immersion in the water pool 1 for operation proximate to the interior wall surface 8 (wall surface cleaning mode). Embodiments of the invention can also be configured to selectively rise to the water surface 7 for operation proximate thereto (water surface cleaning mode).

The unitary body 6 preferably comprises an essentially rigid structure having a hydrodynamically contoured exterior surface for efficient travel through the water. Although the body 6 can be variously configured it is intended that it be relatively compact in size, preferably fitting within a two foot cube envelope. FIG. 1 depicts a heavier-than-water body 6 which in its quiescent or rest state typically sinks to a position (represented in solid line) proximate to the bottom of the pool 1. For operation in the water surface cleaning mode, a vertical force is produced to lift the body 6 to proximate to the water surface 7 (represented in dash line). Alternatively, body 6 can be configured to be lighter-than-water such that in its quiescent or rest state, it floats proximate to the water surface 7. For operation in the wall surface cleaning mode, a vertical force is produced to cause the lighter-than-water body to descend to the pool bottom.

In accordance with the present invention, the body 6 is configured to be propelled along a travel path through the pool 1 powered by a positive pressure water flow supplied via flexible hose 9 from an electrically driven motor and hydraulic pump assembly 10. The assembly 10 defines a pressure side outlet 11 preferably coupled via a pressure/flow regulator 12A and quick disconnect coupling 12B to the flexible hose 9. The hose 9 can be formed of multiple sections coupled in tandem by hose nuts and swivels 13. Further, the hose can be configured with appropriately placed floats 14 and distributed weight so that a significant portion of its length normally rest on the bottom of wall surface 8.

As represented in FIG. 1, the body 6 generally comprises a top portion or frame 6T and a bottom portion or chassis 6B, spaced in a nominally vertical direction. The body also generally defines a front or nose portion 6F and a rear or tail portion 6R spaced in a nominally horizontal direction. The body is supported on a traction means such as wheels 15 which are mounted for engaging the wall surface 8 when operating in the wall surface cleaning mode.

Figure 2:
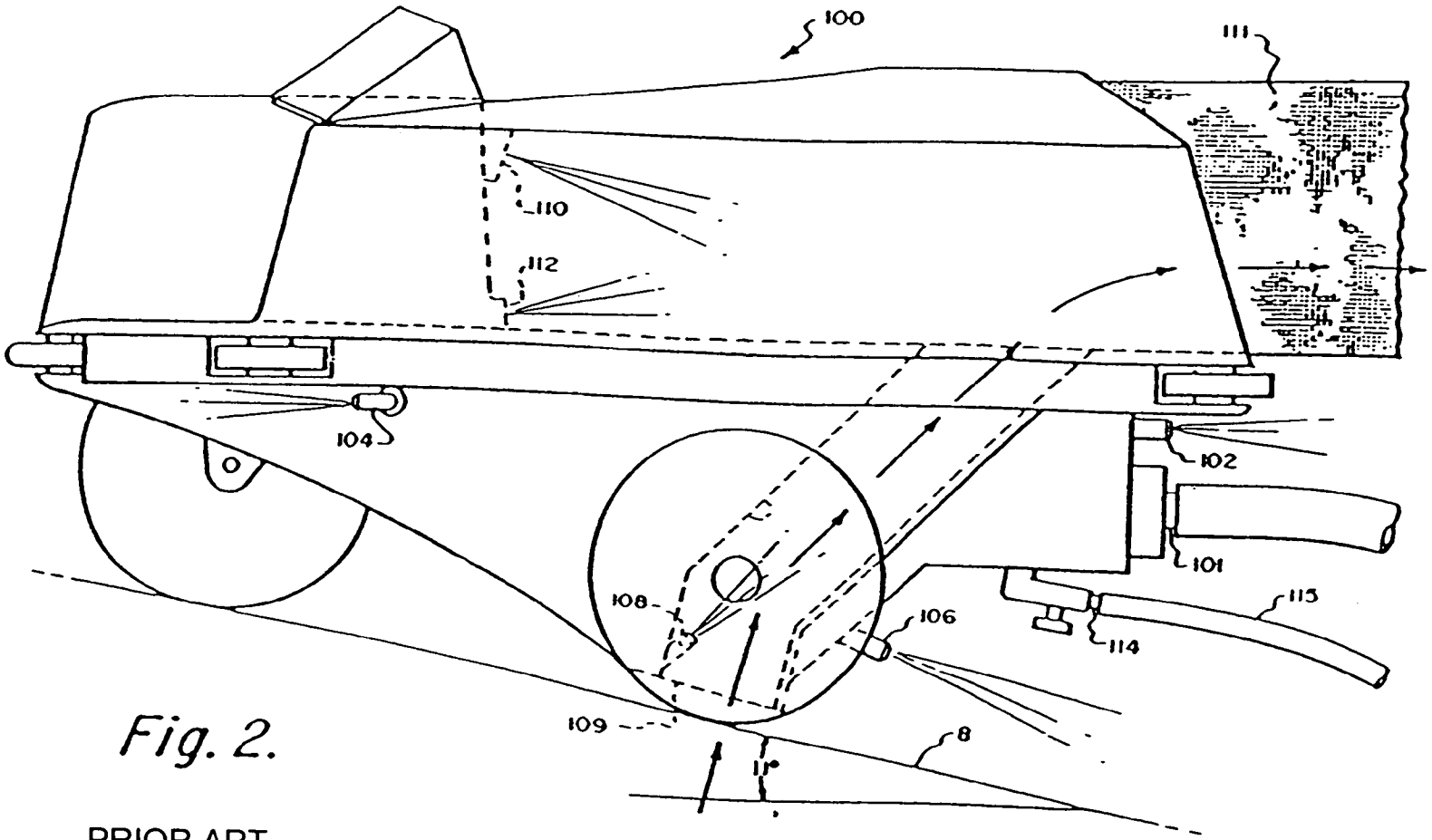
Fig. 2. PRIOR ART
FIG. 2 substantially corresponds to FIG. 2 of U.S. Pat. No. 6,365,039 and schematically depicts a side view of an exemplary pool cleaner body.

Attention is now directed to FIG. 2 which substantially corresponds to FIG. 2 of U.S. Pat. No. 6,365,039 and schematically depicts a unitary cleaner body 100 having a positive pressure water supply inlet 101 and multiple water outlets which are variously used by the body 100 in its different modes and states. The particular outlets active during the forward wall surface travel state and during the backup/redirect travel state in accordance with the present invention are respectively shown in FIGS. 3A-3D and FIGS. 4A-4D.

With reference to FIG. 2, the following water outlets are depicted:

102—Forward Thrust Jet; provides forward propulsion and a downward force in the wall surface cleaning mode to assist in holding the traction wheels against the wall surface 8.

104—Rearward ("backup") Thrust Jet; provides backward propulsion and rotation of the body around a vertical axis when in the backup/redirect state;

106—Forward Thrust/Lift Jet; provides thrust to lift the cleaner body to the water surface and to hold it there and propel it forwardly when operating in the water surface cleaning mode;

108—Vacuum Jet Pump Nozzle; produces a high velocity jet to create a suction at the vacuum inlet opening 109 to pull in water and debris from the adjacent wall surface 8 in the wall surface cleaning mode;

110—Skimmer Jets; provide a flow surface water and debris into a debris container 111 when operating in the water surface cleaning mode;

112—Debris Retention Jets; provides a flow of water toward the mouth of the debris container 111 to keep debris from escaping when operating in the backup/redirect state;

114—Sweep Hose; discharges a water flow through hose 115 to cause it to whip and sweep against wall surface 8.

Figure 3C:
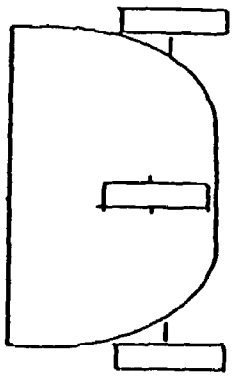
FIGS. 3A, 3B, 3C, 3D schematically illustrate respective top, side, front, and rear views of a pool cleaner body showing a preferred configuration of nozzles for discharging respective water flows to propel the body along a travel path at the wall surface or at the water surface.
Figure 3A:
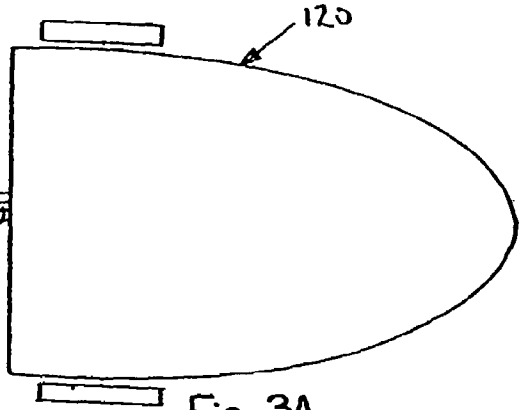
Figure 3B:
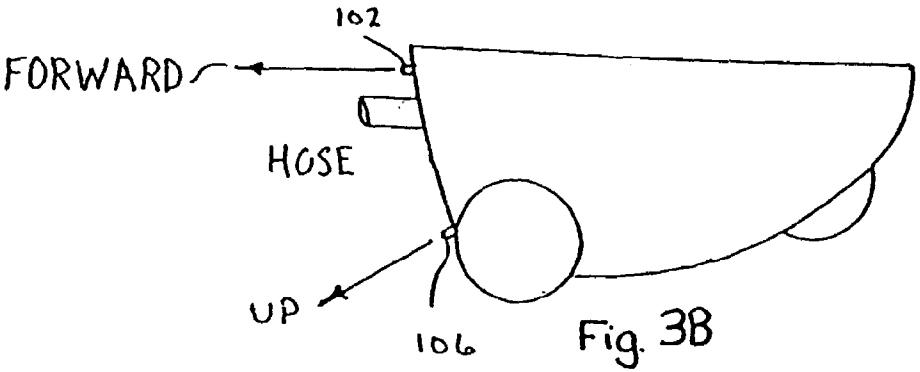
Figure 3D:
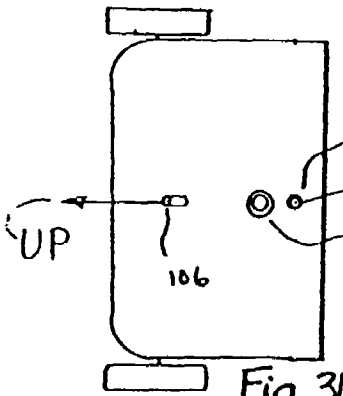
Figures 4A, 4B, 4C, 4D:
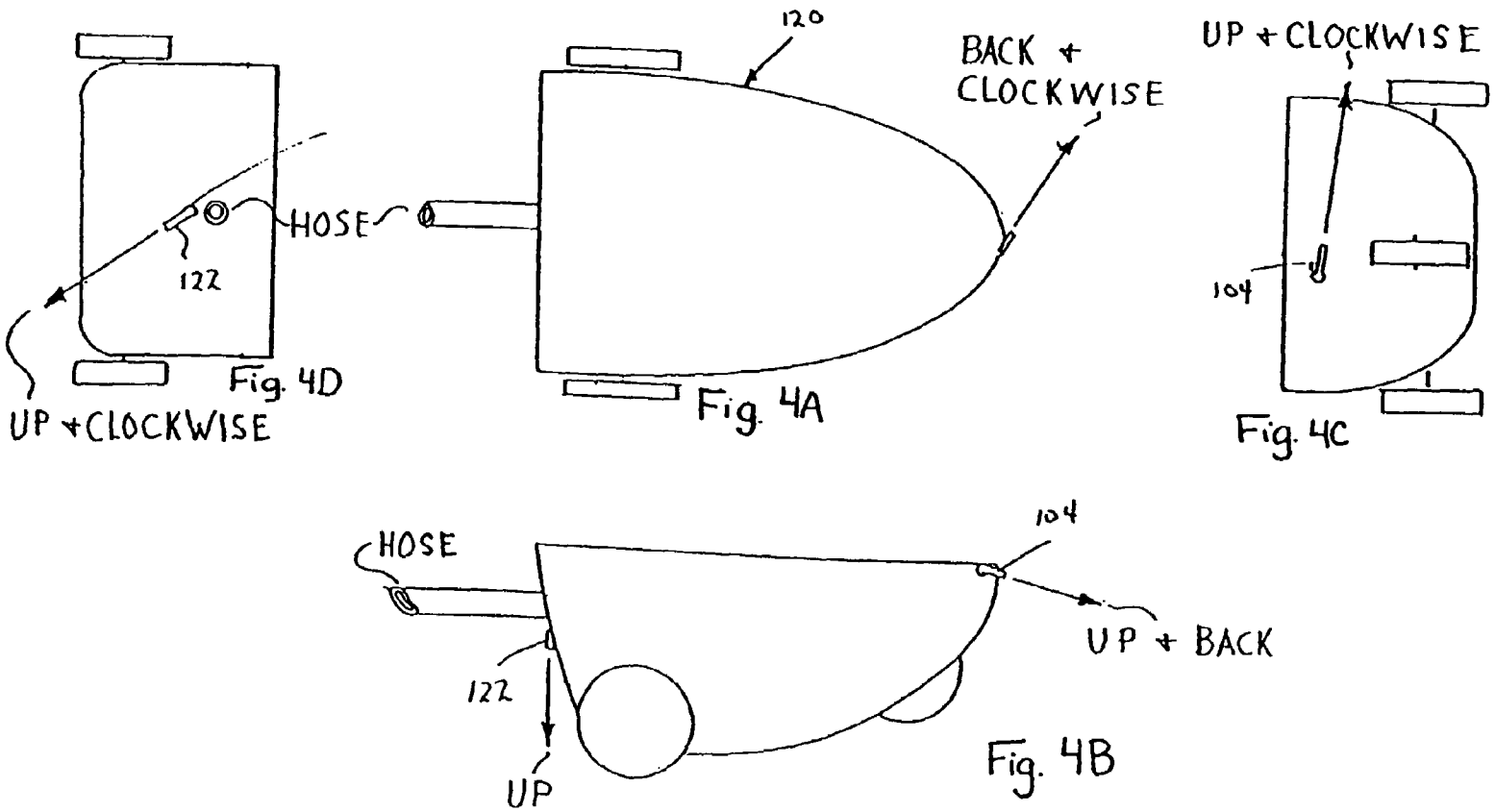
FIGS. 4A, 4B, 4C, 4D schematically illustrate respective top, side, front and rear views of the pool cleaner of FIG. 3 showing a preferred configuration of nozzles for discharging respective water flows for redirecting the body's travel path.

Attention is now directed to FIGS. 3A, 3B, 3C, and 3D which schematically illustrate top, side, front, and rear views of a cleaner body 120 in accordance with the present invention. These figures show the water outlets used for discharging water jets during wall surface and/or water surface cleaning operation for forward propulsion. Note initially that FIGS. 3A, 3B, and 3D illustrate a discharge nozzle 102 oriented to discharge a water jet rearwardly during wall surface operation substantially along the longitudinal centerline of the body 120, i.e., from rear portion 6R to nose portion 6F to produce a thrust on the body to propel it in a first or forward direction.

FIGS. 3B and 3D illustrate a second nozzle 106 mounted at the rear of body 120 below the nozzle 102 but also substantially aligned with the longitudinal center line of the body 120. Note that the nozzle 106 is oriented to discharge a water jet rearwardly and downwardly to produce a vertical force for lifting the body 120 to the water surface and a forward thrust for propelling the body along the water surface. The jet discharged from nozzle 106 acts to maintain the body at the water surface while propelling it forwardly in the forward/water surface travel state.

Attention is now directed to FIGS. 4A, 4B, 4C, and 4D which schematically illustrate the top, side, front, and rear views of the cleaner body 120 in accordance with the present invention showing a front backup/redirect nozzle 104 and an additional rear backup/redirect nozzle 122. The nozzles 104 and 122 are used during the backup/redirect state to redirect the travel path of the body 120 and enable it to avoid being trapped by obstructions in the pool. More particularly, note in FIG. 4A that nozzle 104 mounted at the front of body 120 is oriented to discharge a water jet having a horizontal component extending to the left and that nozzle 122 mounted at the rear of body 120 is oriented to discharge a water jet having a horizontal component extending to the right. The forces attributable to these oppositely directed horizontal components discharged from spaced nozzles 104 and 122 act cooperatively to produce a turning moment around the body's center of gravity to rotate the body in a clockwise direction and enable it to resume forward travel along a redirected path. In order to facilitate rotation of the body 120 when operating in the wall surface mode with wheels 15 engaged against wall surface 8, it is preferable that the body be lifted slightly to disengage the traction wheels 15 from the wall surface. Accordingly, it is preferable that at least one of the nozzles 104, 122 be oriented so that the jet discharged there from has a vertical component acting to lift the body and wheels 15 from the wall surface. It should also be noted in FIG. 4A that the nozzle 104 is oriented so that the jet discharged there from has a forward component to produce a force acting to cause the body to move rearwardly, i.e., backup, to facilitate the body extricating itself from behind an obstruction.

Thus, it should be appreciated that when the cleaner body is operating in the backup/redirect state, represented by FIGS. 4A-4D, water jets discharged from nozzles 104 and 122 cooperate to cause the body to backup, lift, and rotate to free the body from an obstruction and modify or redirect its travel path.

Figure 5:
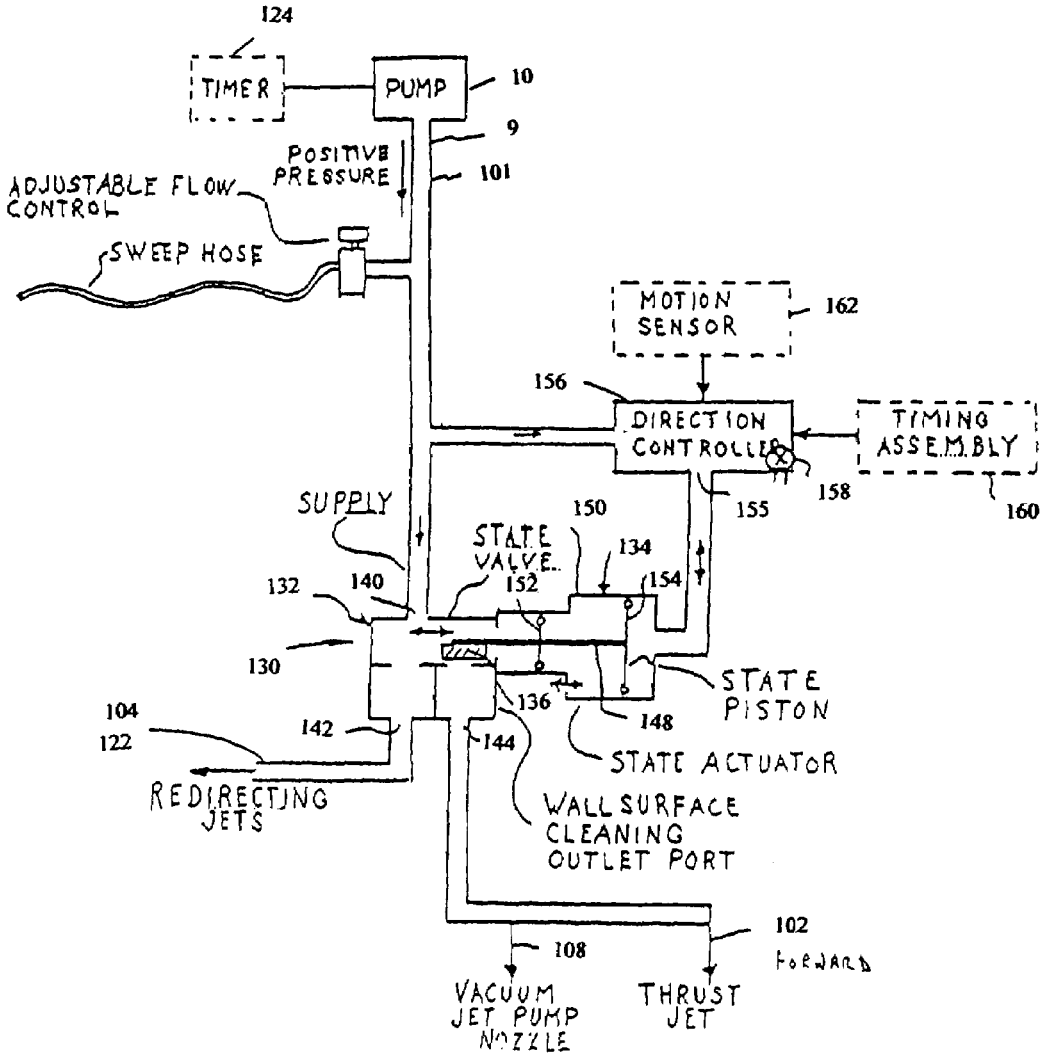
FIG. 5 is a functional block diagram depicting water flow distribution in a propulsion subsystem in accordance with the invention showing a preferred two state valve assembly embodiment for selectively directing water flows to respective discharge outlets in the forward travel state arid the redirect travel state.

Attention is now directed to FIG. 5 which schematically depicts how positive pressure water supplied to inlet 101 from pump 10 is distributed to the various body outlets shown in FIGS. 3 and 4. The pump 10 is typically controlled by an optional timer 124 to periodically supply positive pressure water via supply hose 9 to inlet 101. The supplied water is then variously distributed as shown in FIG. 5 to the various water outlets on the body 120 depending upon the defined mode and state.

More particularly, water supplied to inlet 101 is directed to a state valve assembly 130 comprised of a valve body 132 and a hydraulic actuator 134 for controlling the position of a valve element 136 mounted for reciprocal linear movement in the valve body 132. Valve body 132 includes an inlet port 140 and first and second outlet ports 142, 144. The hydraulic valve actuator 134 is configured to move the valve element 136 between a default position (shown in FIG. 5) and an active position to selectively close either one of the outlet ports 142, 144. In the forward travel state, valve element 136 moves to its active position to close outlet port 142 and open outlet port 144. As a consequence, positive pressure water supplied by pump 10 to inlet port 140 is directed through outlet port 144 to forward thrust jet 102 and vacuum jet pump 108. In the redirect state, valve element 136 moves to its default position to close outlet port 144 and open outlet port 142 to direct the supplied positive pressure flow to redirect outlets 104, 122.

The hydraulic valve actuator 134 is comprised of a piston 148 mounted in chamber 150 for reciprocal linear movement. The piston 148 defines oppositely directed first and second faces 152, 154. The first face 152 is exposed to the positive supply pressure in valve body 132. The second face 154 is exposed to pressure supplied from outlet 155 of direction controller 156. The positive supply pressure flow from pump 10 is supplied to direction controller 156 which selectively either directs it to piston face 154 or vents it to the pool environment via a vent valve 158. The vent valve 158 is opened either periodically by a timing assembly 160 and/or irregularly in response to an event, such as the cessation of body motion detected by motion sensor 162. Thus, the timing assembly 160 and motion sensor 162 control the application of the supplied positive pressure flow from pump 10 to piston face 154 via direction controller outlet 155.

It is to be noted in FIG. 5 that the piston faces 152 and 154 have different effective areas. That is, the piston face 154 is shown as having a larger area than that of piston face 152. As a consequence, when the positive supply pressure is concurrently applied to both faces 152 and 154, a greater force will be developed on face 154 to move the piston 148 and valve element 136 to the left (as viewed in FIG. 5), or active position, to open valve outlet port 144 to supply positive pressure water flow to forward thrust jet 102 and vacuum jet pump 108. On the other hand, when the timing assembly and/or motion sensor open the direction controller vent valve 158, this will relieve the pressure on piston face 154 and enable the supply pressure on face 152 to restore the valve element 136 to the right (as viewed in FIG. 5), or default position.

Figure 6:
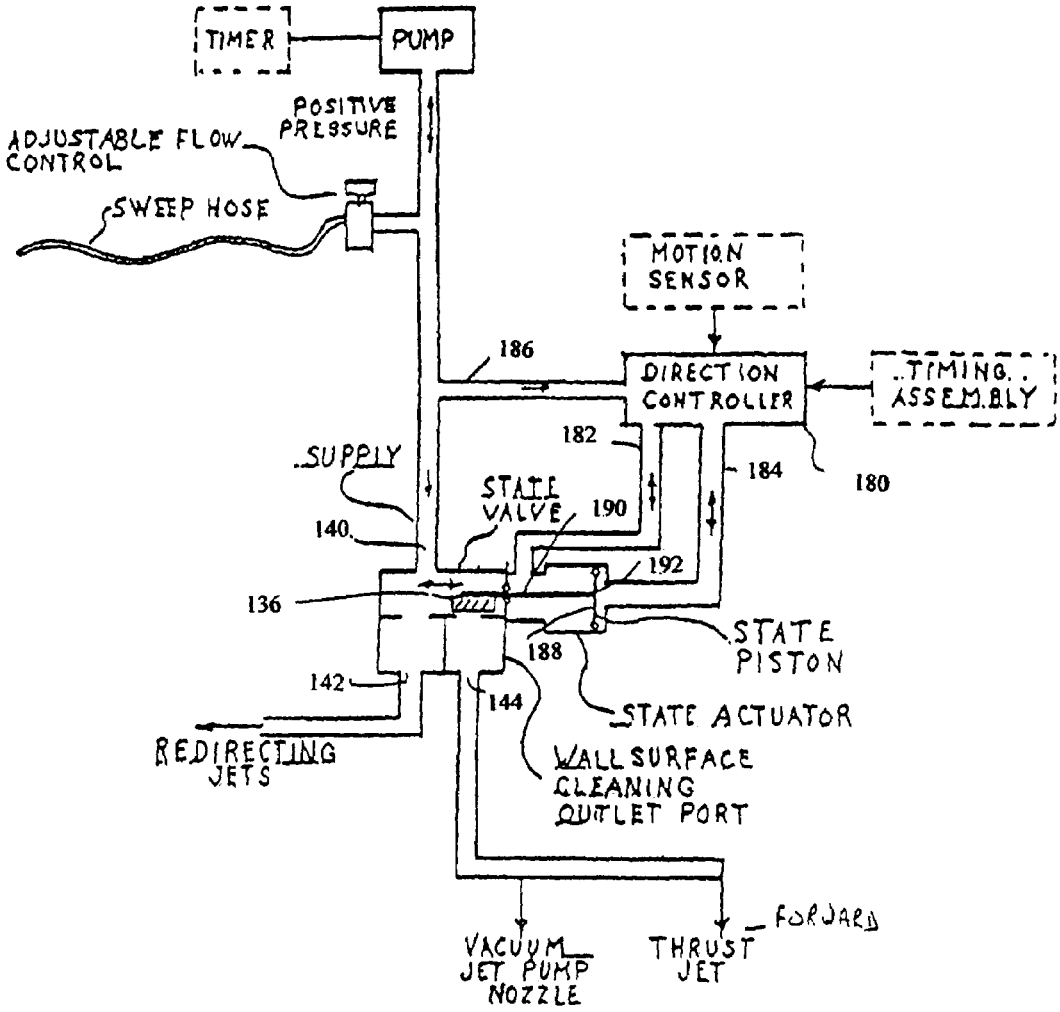
FIG. 6 is a functional block diagram similar to FIG. 5 but showing an alternative two state valve assembly embodiment.

Attention is now directed to FIG. 6 which depicts a propulsion subsystem in accordance with the invention similar to that shown in FIG. 5 but differing there from in the implementation of the hydraulic actuator and direction controller. That is, it will be recalled from FIG. 5 that the direction controller 156 has a single outlet 155. In contrast, the direction controller 180 of FIG. 6 has two outlets, i.e., 182, 184. The direction controller 180 operates to selectively couple the positive pressure supplied to inlet 186 to either outlet 182 or outlet 184. Positive pressure coupled to outlet 182 bears against a first face 188 of piston 190 to move the piston to the right (default position) as viewed in FIG. 6. Positive pressure coupled to outlet 184 bears against the second piston face 192 to drive the piston to the left or active position.

As was explained in connection with FIG. 5, when operating in the redirect state, the piston is in the right or default position depicted in FIG. 6 with valve element 136 blocking valve body outlet 144. When controller outlet 184 provides positive pressure to piston face 192 to drive the piston to the left, then valve element 136 blocks outlet 142 and opens outlet 144 to supply a positive pressure flow to discharge outlets 102 and 108.

Figure 7:
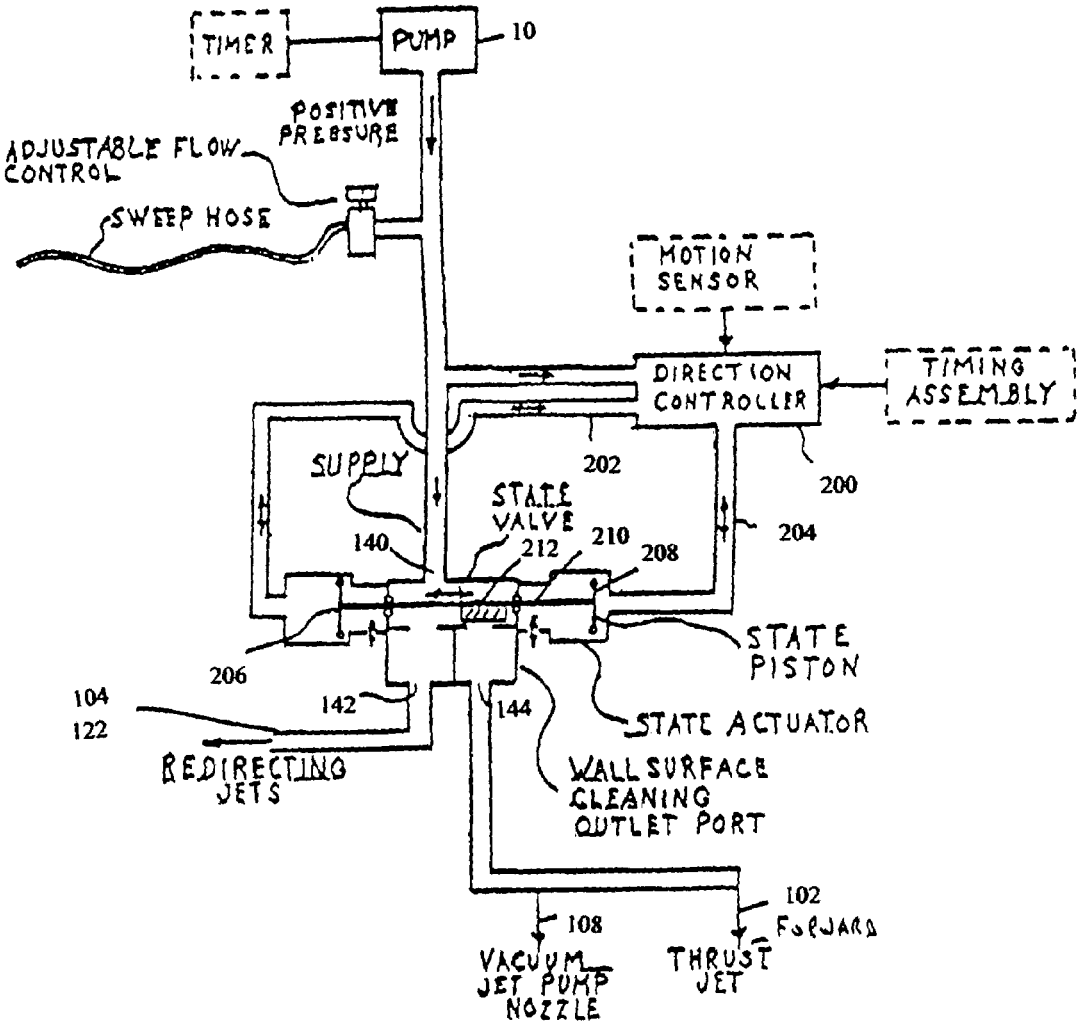
FIG. 7 is a functional block diagram similar to FIG. 6 but showing a further alternative two state valve assembly embodiment.

FIG. 7 illustrates a still further alternative arrangement of the propulsion subsystem shown in FIG. 6. The direction controller 200 of FIG. 7 includes first and second outlets 202, 204 corresponding to the two outlets of controller 180 in FIG. 6. The outlets 202 and 204 respectively function to apply pressure to piston faces 206 and 208. The faces 206 and 208 are coupled by a piston rod 210 which carries a valve element 212. When the direction controller 200 applies a positive pressure via outlet 202 to piston face 206, it moves the piston rod and valve element 212 to the right position shown in FIG. 6, closing valve outlet 144 and opening valve outlet 142 to define the redirect state. This valve position of course permits the positive pressure supply from pump 10 to flow through valve outlet 142 to the redirecting jet outlets 104, 122 (FIG. 4). On the other hand, when controller 200 supplies positive pressure via outlet 204 to piston face 208, valve element 212 will move to the left, or active, position thereby closing valve outlet 142 and opening valve outlet 144. In this position, the positive pressure water supplied from pump 10 will be steered through valve outlet 144 to the nozzles 102 and 108 for operation in the forward wall surface mode.

It should thus now be appreciated that the propulsion subsystems depicted in FIGS. 5, 6, and 7 all use a hydraulic valve actuator for operating a two state valve for directing a supplied water flow to either forward propulsion discharge outlets or redirect discharge outlets. In each of the embodiments depicted in FIGS. 5, 6, and 7 the actuator is hydraulically driven between its two states without requiring the use of a spring restoration force. That is, in all of the embodiments a pressure applied to one piston face drives the piston in one direction whereas a pressure applied to a second piston face drives the piston in an opposite direction to a second position.

Figure 8:
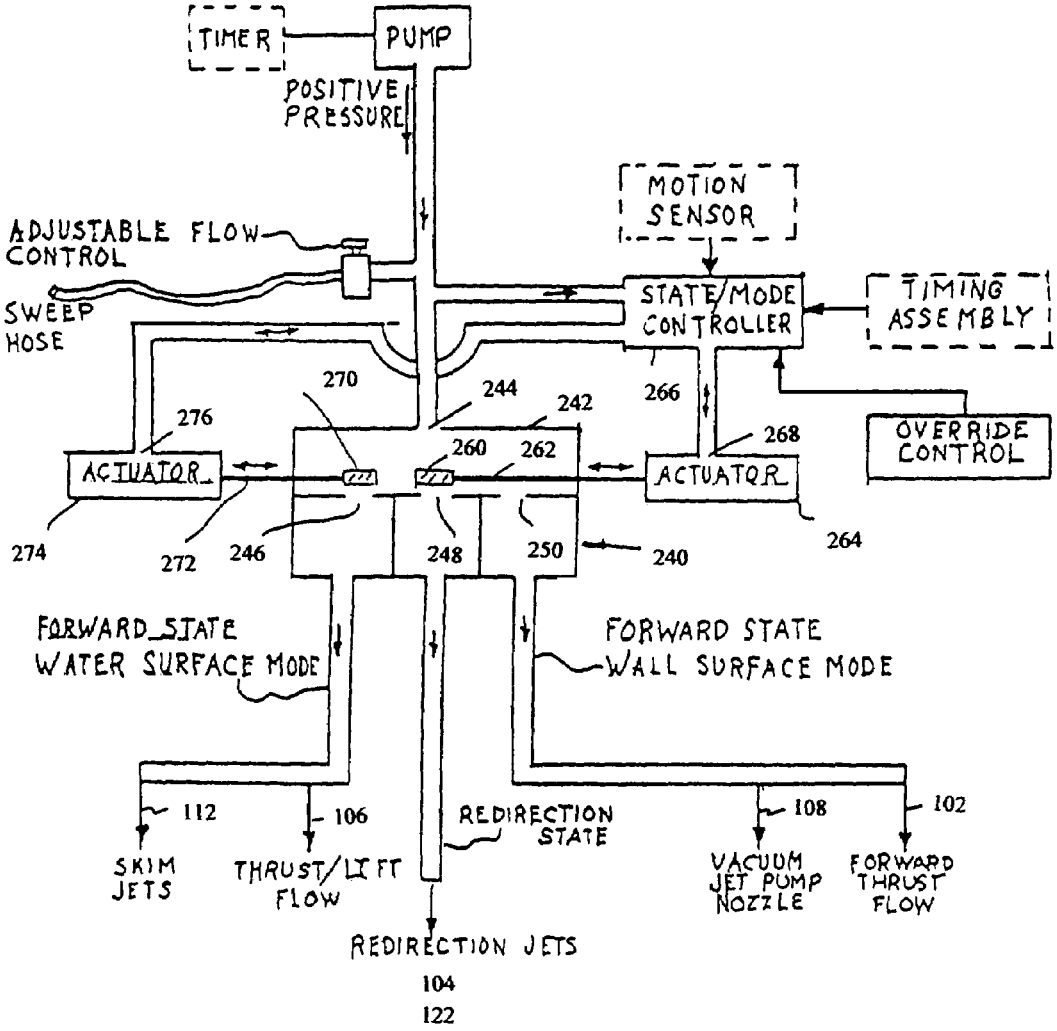
FIG. 8 is a functional block diagram depicting water flow distribution in accordance with the invention and showing a preferred three state valve assembly embodiment for selectively directing water flows to respective discharge outlets for forward/water surface travel, forward/wall surface travel, and redirect travel.

It should be understood that the propulsion subsystem embodiments depicted in FIGS. 5, 6, and 7 are all comprised of two state valves enabling the subsystem to be operated in either a forward propulsion state or a redirect state. In systems intended to also operate in top and bottom modes for respectively cleaning both the water surface and wall surface, it is necessary to define at least three valve states. Three separate valve states can be defined by properly controlling two state valves (e.g., of the type shown in FIGS. 5, 6, and 7) coupled in tandem. Alternatively, and preferably, a three state valve assembly 240 as shown in FIG. 8 can be used. More particularly, valve assembly 240 is comprised of a valve body 242 having a supply inlet 244 and three outlets 246, 248, and 250. Outlet 246 leads to jets 112 and 106 (depicted in FIG. 2) which are used during the forward travel state water surface mode. Outlet 250 is coupled to vacuum jet pump outlet 108 and forward thrust outlet 102 (FIG. 2) which are used in the forward travel state wall surface mode. Outlet 248 is coupled to the redirection jets 104, 122 depicted in FIG. 4.

The outlets 246, 248, and 250 are preferably mounted in alignment with the outlet 248 located between the outlets 246 and 250. A first valve element 260 is mounted on piston rod 262 operated by actuator 264. The actuator 264 is selectively driven to either of two positions by a pressure supplied by state/mode controller 266 to the actuator inlet 268. Thus, actuator 264 is able to move valve element 260 linearly to selectively close either outlet 248 or outlet 250.

A second valve element 270 is carried by piston rod 272 operated by a second actuator 274. The actuator 274 responds to a pressure applied to its inlet 276 by controller 266 to linearly move valve element 270 to selectively close either valve outlet 246 or valve outlet 248.

FIG. 8 illustrates the valve element 260 in its left position and the valve element 270 in its left position. This positioning opens valve outlet 250 to supply positive pressure water flow to outlets 108 and 102 for forward travel in the wall surface mode. Actuation of actuator 264 to move valve element 260 to the right closes valve outlet 250 and opens outlet 248 to supply a positive pressure to redirection jets 104 and 122. Actuation of actuator 274 will move valve element 270 to the right to close redirection outlet 248 and open the forward travel water surface outlet 246.

Thus, when valve outlet 250 is open, the cleaner body travels forward in the wall surface mode. On the other hand, when valve outlet 246 is open, the cleaner body travels in a forward direction in the water surface mode. Regardless of which forward mode the system is operating in, if the redirection state is initiated by motion sensor 162 or timing assembly 160, only one of the actuators has to be activated to open redirection outlet 248.

Although the present invention has been described in detail with reference to only a limited number of embodiments, those skilled in the art will readily appreciate that various modifications and alternatives can be used without departing from the spirit or intended scope of the invention as defined by the appended claims.

The invention claimed is:

1. Apparatus for cleaning the interior surface of a containment wall containing a water pool, said apparatus comprising:

a body adapted to be immersed in said water pool;

at least one first discharge outlet on said body oriented to discharge a water flow in a direction acting to move said body in a first direction;

at least one second discharge outlet on said body oriented to discharge a water flow in a direction acting to move said body in a second direction different from said first direction; and a propulsion subsystem for selectively providing a water flow to said first discharge outlet or said second discharge outlet, said propulsion subsystem comprising:

a valve assembly including an inlet port and first and second outlet ports, said inlet port being adapted to receive a water flow supplied by a positive pressure source, said first outlet port being coupled to said first discharge outlet, and said second outlet port being coupled to said second discharge outlet;

a valve element mounted for reciprocal linear movement between first and second positions such that said valve element in said first position closes said second outlet port and in said second position closes said first outlet port;

a hydraulic actuator for moving said valve element between said first and second positions, said actuator comprising at least one piston having first and second oppositely directed faces; and means for selectively applying water pressure supplied by said positive pressure source to said faces to selectively move said valve element to said first position or second position.

2. The apparatus of claim 1 wherein said means applying water pressure to said faces includes means continuously applying said water pressure to said second face acting in a direction to restore said valve element to said second position; and means for selectively applying said water pressure to said first face for moving said valve element to said first position.

3. The apparatus of claim 1 wherein said means for applying water pressure to said first face includes a controller having a first control port and wherein said controller is operable to selectively produce said water pressure at said first control port.

4. The apparatus of claim 1 wherein said piston first face has an area larger than the area of said second face whereby an equal pressure applied to said first and second faces produces a greater force on said first face for moving said valve element to said first position.

5. The apparatus of claim 1 wherein said means applying water pressure to said faces includes a controller selectively operable to apply said pressure to either said first face or said second face.

6. The apparatus of claim 1 wherein said second discharge outlet includes first and second nozzles mounted on said body in spaced relationship and oriented to discharge water flows having spaced horizontal components for producing a moment to rotate said body.

7. The apparatus of claim 6 wherein at least one of said nozzles is oriented to discharge a water flow having a vertical component for lifting said body.

* * * * *